US010893993B2

(12) United States Patent
Stratton

(10) Patent No.: US 10,893,993 B2
(45) Date of Patent: Jan. 19, 2021

(54) PORTABLE DISABILITY ACCESS DEVICE

(71) Applicants: David Stratton, Newstead (AU); Rodney Brooke, Talbot (AU)

(72) Inventor: David Stratton, Newstead (AU)

(73) Assignee: Rodney Brooke, Talbot (AU)

( * ) Notice: Subject to any disclaimer, the term of this patent is extended or adjusted under 35 U.S.C. 154(b) by 13 days.

(21) Appl. No.: 16/098,714

(22) PCT Filed: Apr. 28, 2017

(86) PCT No.: PCT/AU2017/000097
§ 371 (c)(1),
(2) Date: Nov. 2, 2018

(87) PCT Pub. No.: WO2017/190176
PCT Pub. Date: Nov. 9, 2017

(65) Prior Publication Data

US 2019/0117486 A1 Apr. 25, 2019

(30) Foreign Application Priority Data

May 3, 2016 (AU) ..... 2016901621

(51) Int. Cl.
*A61G 7/053* (2006.01)
*A61G 7/05* (2006.01)
*A47C 21/08* (2006.01)
*A47C 21/00* (2006.01)

(52) U.S. Cl.
CPC ..... *A61G 7/053* (2013.01); *A47C 21/00* (2013.01); *A47C 21/08* (2013.01); *A61G 7/05* (2013.01)

(58) Field of Classification Search
CPC ..... A47C 21/00; A47C 21/08; A47C 31/00; A61G 7/05; A61G 7/0507; A61G 7/053; F16M 11/24; F16M 11/242; F16M 11/245; F16M 11/26; F16M 11/28; F16M 11/32; F16M 11/34; F16M 11/38
USPC ..... 5/662, 659, 658, 425, 426, 428, 430; 248/166, 170, 173, 188.6, 188.7
See application file for complete search history.

(56) References Cited

U.S. PATENT DOCUMENTS 329,663 A * 11/1885 McMurray ..... A61G 7/0507 5/426
1,863,756 A * 6/1932 Lufkin ..... E01F 9/688 248/170
2,859,454 A * 11/1958 Beckwell ..... A61G 7/0518 5/426
2,904,799 A * 9/1959 Berlin ..... A47C 21/08 5/426
2,991,487 A * 7/1961 Beckwell ..... A47C 21/08 5/426

(Continued)

FOREIGN PATENT DOCUMENTS

WO 2016070227 A1 5/2016

*Primary Examiner* — Robert G Santos
(74) *Attorney, Agent, or Firm* — Steven M. Shape; Dennemeyer & Associates, LLC

(57) ABSTRACT

A foldable, portable disability bed support which has a portion disposable under a mattress and a vertical post for use in self-supporting a disabled person. The bed support includes a base connector to which the vertical post is attached. The base connector is adapted to accept attachment of the base arms in either an operative position or in a folded position in which the base arms lie alongside the support post.

3 Claims, 10 Drawing Sheets

(56) References Cited

U.S. PATENT DOCUMENTS 3,290,701 A * 12/1966 Luff ..... A47C 21/08 5/426
4,671,479 A * 6/1987 Johnson ..... F16M 11/16 248/173
4,744,536 A * 5/1988 Bancalari ..... A61M 5/1415 248/125.8
5,310,145 A * 5/1994 Chen ..... F21S 6/006 248/170
5,318,258 A * 6/1994 Lang ..... E01F 9/688 248/166
5,340,068 A * 8/1994 Sarkisian ..... F16M 11/16 248/170
5,400,450 A 3/1995 Leoutsakos
5,596,776 A * 1/1997 Huang ..... A47C 21/08 5/426
5,611,509 A * 3/1997 Kulp ..... F16M 11/16 248/171
5,671,490 A * 9/1997 Wu ..... A47C 21/08 5/426
5,829,178 A * 11/1998 Hillstrom ..... G09F 15/0062 40/610
6,007,032 A * 12/1999 Kuo ..... F16M 11/10 248/125.1
6,311,942 B1 * 11/2001 Rotter ..... A61G 7/053 135/65
6,401,280 B1 * 6/2002 Baker ..... A47C 21/08 5/426
6,685,156 B2 * 2/2004 Dicke ..... E01F 9/688 248/166
6,695,268 B1 * 2/2004 Hsieh ..... A47B 19/002 248/188.7
6,793,191 B1 * 9/2004 Williams ..... F16M 11/16 248/166
6,813,789 B2 * 11/2004 Leoutsakos ..... A47C 19/02 5/424
6,952,846 B2 * 10/2005 Flannery ..... A47C 21/08 5/425
6,952,847 B1 * 10/2005 Cleary ..... A47C 21/08 5/426
6,990,697 B1 * 1/2006 Clute ..... A47C 21/08 5/425
7,013,508 B2 * 3/2006 Wu ..... A47C 21/08 5/426
7,021,592 B2 * 4/2006 Brandes ..... F16M 11/14 248/178.1
7,032,265 B2 * 4/2006 Miller ..... A47C 21/00 5/658
7,137,158 B2 * 11/2006 Flannery ..... A47C 21/08 5/425
7,178,184 B2 * 2/2007 Flannery ..... A47C 21/08 5/425
7,181,788 B2 * 2/2007 Flannery ..... A47C 21/08 5/425
7,302,720 B2 * 12/2007 Flannery ..... A47C 21/08 403/329
7,373,679 B2 * 5/2008 Miller ..... A47C 21/08 5/426
7,472,445 B2 * 1/2009 Miller ..... A47C 21/00 5/652
7,640,606 B2 * 1/2010 Flannery ..... A47C 21/08 5/425
7,669,815 B2 * 3/2010 Clewett ..... E01F 9/692 248/166
7,913,333 B2 * 3/2011 Flannery ..... A47C 21/08 5/425
8,122,629 B2 * 2/2012 Cowgill ..... G09F 15/0062 40/610
D687,421 S * 8/2013 Slaton ..... D14/229
8,973,192 B2 * 3/2015 Miller ..... A47C 21/08 5/662
9,155,401 B1 * 10/2015 Wergedal ..... A47C 21/028
9,387,141 B1 * 7/2016 Flannery ..... A61G 7/0507
9,427,088 B2 * 8/2016 Miller ..... A61G 7/0507
9,476,173 B1 * 10/2016 Wielenga ..... F16M 11/245
9,955,792 B2 * 5/2018 Miller ..... A61G 7/0507
10,548,408 B1 * 2/2020 Flannery ..... A47D 7/02
2002/0078502 A1 * 6/2002 Baker ..... A47C 21/08 5/429
2003/0024047 A1 * 2/2003 Wu ..... A47C 21/08 5/430
2003/0213888 A1 * 11/2003 Dicke ..... E01F 9/688 248/624
2004/0040089 A1 * 3/2004 Flannery ..... A47C 21/08 5/425
2004/0049855 A1 3/2004 Leoutsakos
2004/0181877 A1 9/2004 Miller
2004/0187209 A1 * 9/2004 Flannery ..... A47C 21/08 5/425
2005/0178935 A1 * 8/2005 Brandes ..... F16M 11/24 248/177.1
2005/0229310 A1 * 10/2005 Flannery ..... A47C 21/08 5/430
2005/0262632 A1 * 12/2005 Wu ..... A47C 21/08 5/426
2006/0026759 A1 * 2/2006 Flannery ..... A47C 21/08 5/426
2006/0037140 A1 * 2/2006 Clute ..... A47C 21/08 5/430
2006/0253990 A1 * 11/2006 Miller ..... A47C 21/00 5/662
2007/0083994 A1 * 4/2007 Miller ..... A47C 21/08 5/662
2007/0101494 A1 * 5/2007 Flannery ..... A61G 7/0518 5/430
2008/0155748 A1 * 7/2008 Flannery ..... A47C 21/08 5/426
2008/0197252 A1 * 8/2008 Clewett ..... E04H 12/2238 248/220.21
2009/0139124 A1 * 6/2009 Cowgill ..... G09F 17/00 40/610
2010/0101021 A1 * 4/2010 Flannery ..... A47C 21/08 5/426
2012/0117926 A1 * 5/2012 Miller ..... A47C 21/08 53/473
2015/0216750 A1 * 8/2015 Miller ..... A61G 7/0507 5/662
2016/0360895 A1 * 12/2016 Miller ..... A61G 7/0507
2019/0117486 A1 * 4/2019 Stratton ..... A47C 21/00

* cited by examiner

PORTABLE DISABILITY ACCESS DEVICE

This invention relates to a device for use by disabled people to assist them in moving around a bed, to raise themselves to a sitting positon or to assist them in moving between a bed and a wheelchair.

BACKGROUND TO THE INVENTION

The idea of a Bed post or Pole has been around for about 20 years. There are a number of different designs manufactured and offered for sale. The primary purpose of a Bed Post is to provide a stable post at a suitable location along the side of a bed that a person can use to assist them in moving themselves around on the bed and in raising themselves to a sitting position on the side of the bed or conversely assisting to transfer from a wheel chair to the bed.

Currently available Bed Posts fit into two classes. Permanently attached and Removable Bed Posts. Most hospitals that deal with disabled patients have the permanent type. Removable types are generally owned by their user and are taken with them if they move from one residential location to another.

The removable types are generally quite ungainly and take up a lot of space when being moved. They all have a flat frame or plate that slides under the mattress of the bed to provide stability for the post that is fixed to the side of the base frame. The combination of the area of the base and the weight of the person lying/sitting on the bed provides the necessary support and restraint for the bed post to allow it to accept loads in any direction up to the maximum that a person can apply with their arm when in a lying or sitting position. Using AS1428.1-2009 for Grab Rails as a basis this maximum load is 1100 N.

Australian patent 2011218731 discloses a vertical post attachable to a four post bed frame.

Japanese publication 03376385 discloses a bed side support mountable on the bed frame.

Japanese publication 04315518 discloses a vertically slidable handrail attached to a floor board.

Occupational and Physiotherapists working in the disability sector see there is a place for removable bed posts in many situations with the exception of use where the mattress is narrow and very light and flexible (Thin Foam) or the person has cognitive issues that would limit their ability to recognize a dangerous situation. There have been several fatalities involving bed posts. Two scenarios are evident One is where the post has moved allowing a gap between the edge of the mattress and the post to develop which has resulted in a person's head becoming stuck in the gap. Complete rollover of the mattress and person has also resulting in fatalities.

Greater acceptance of the need to provide disability access in many parts of the world has resulted in more people with a disability travelling. The ungainly aspects of the bed post during travel have been highlighted when this travel involves flying.

WO2016/070227 by the present applicants discloses a bed post that provides a vertical post and a portion at right angles that is adapted to lie under a mattress. This design is useful but cumbersome and complicated to manufacture.

It is an object of this invention to ameliorate these problems.

BRIEF DESCRIPTION OF THE INVENTION

To this end the present invention provides a foldable, portable disability bed support which has a portion disposable under a mattress and a vertical support for use in self-supporting a disabled person.

The base portion when inserted under a mattress has at least two arms radially extending from the vertical support.

The portion under the mattress creates a large virtual surface area extending from the upright post toward the centre of the mattress and extending laterally. This shape provides the resistance required to oppose the force applied to the upright post when the disabled person uses it to pull themselves into a sitting position or for support when transferring to a wheel chair.

In another aspect this invention provides a foldable, portable disability bed support which has a base portion consisting of at least two arms disposable under a mattress and a support attached vertically to the base portion for use in self-supporting a disabled person and the at least two arms are spaced apart and radially attached to the base of the vertical support. Preferably the bed support includes a base connector to which the vertical post is attached. This base connector is adapted to accept attachment of the base arms in either an operative position where the arms are at right angles to the support post or in a folded position in which the base arms lie alongside the support post. Preferably the base connector has two recesses for each arm; one recess aligning the arm alongside the vertical post; and the other recess aligning the arms at right angles to the support post. In a further preferred embodiment the base connector has a pivot recess for each arm and each arm has a spring loaded lock so that the arms are able to be placed in a folded position alongside the vertical post and an operative position at right angles to the support post.

The device is easily reassembled with all critical assembly connections identified. The advantages of this invention are:

- Light weight (less than 5 kg). It is made from sections of Aluminium tube, and some solid aluminium parts.
- Packs down quickly and easily to a manageable volume to fit into a case or its own bag.
- Is easily and simply reassembled by plugging the parts together. A preferred alternative is for the radial arms to pivot about the base of the vertical post from an operative position to a foldable position for transportation.
- When assembled all critical stress points and joints are inherently strong and safe. The joints between members may be a simple plug and socket design with an anti-rotation feature to maximize stability of the structure.

DETAILED DESCRIPTION OF THE INVENTION

A preferred embodiment of the invention will now be described with reference to the drawings in which.

Figure 1:
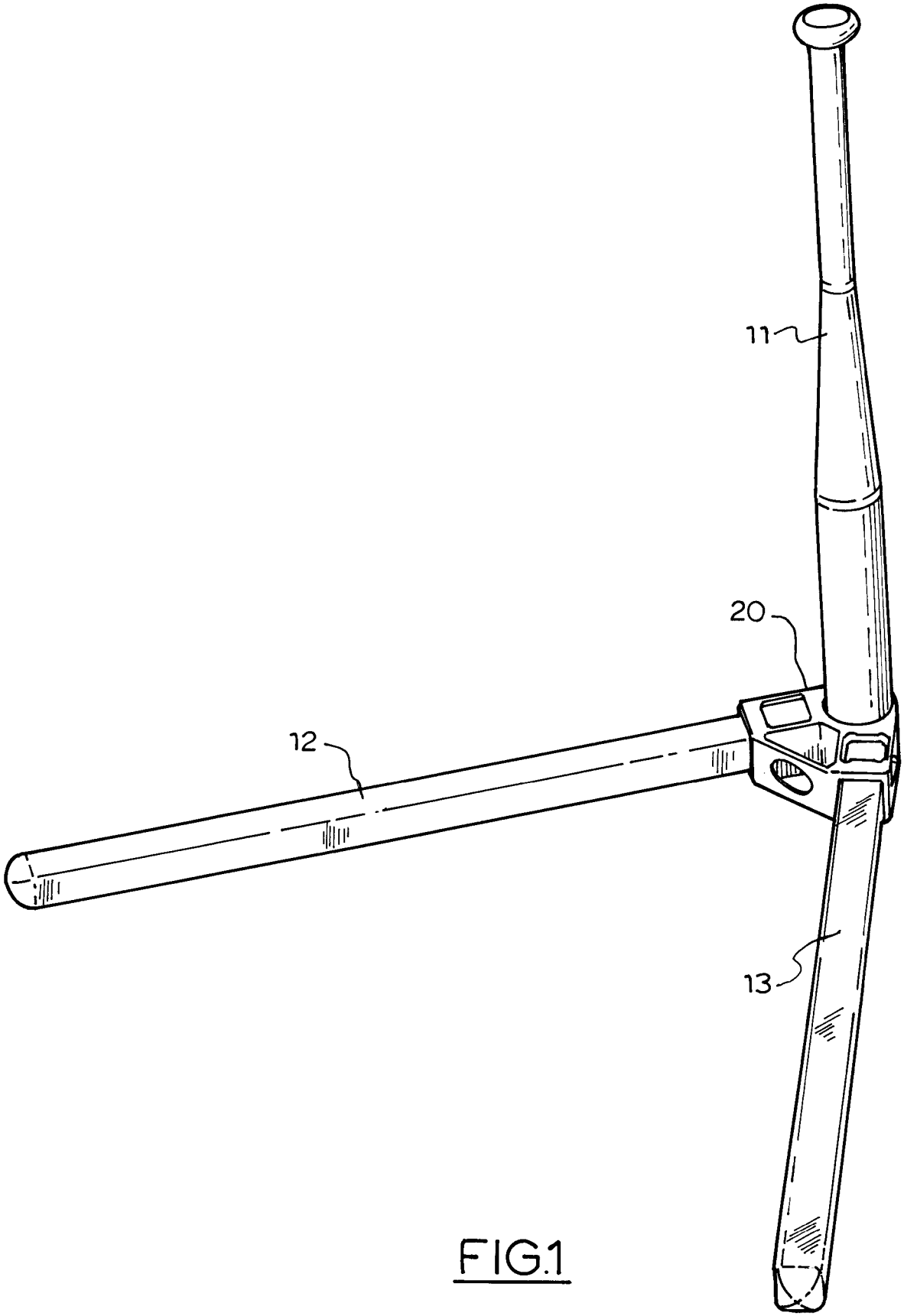
FIG. 1 is a perspective view of a first embodiment of the bed post of this invention.
Figure 2:
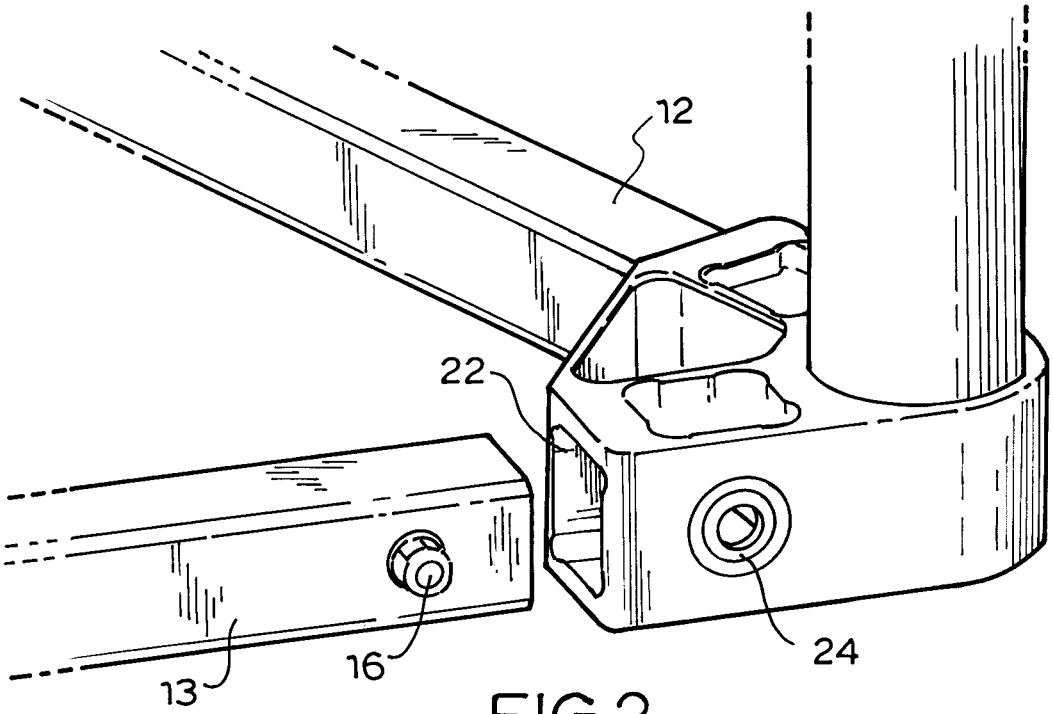
FIG. 2 is a detail showing the assembly of a leg to the vertical post of the embodiment of FIG. 1.
Figure 3:
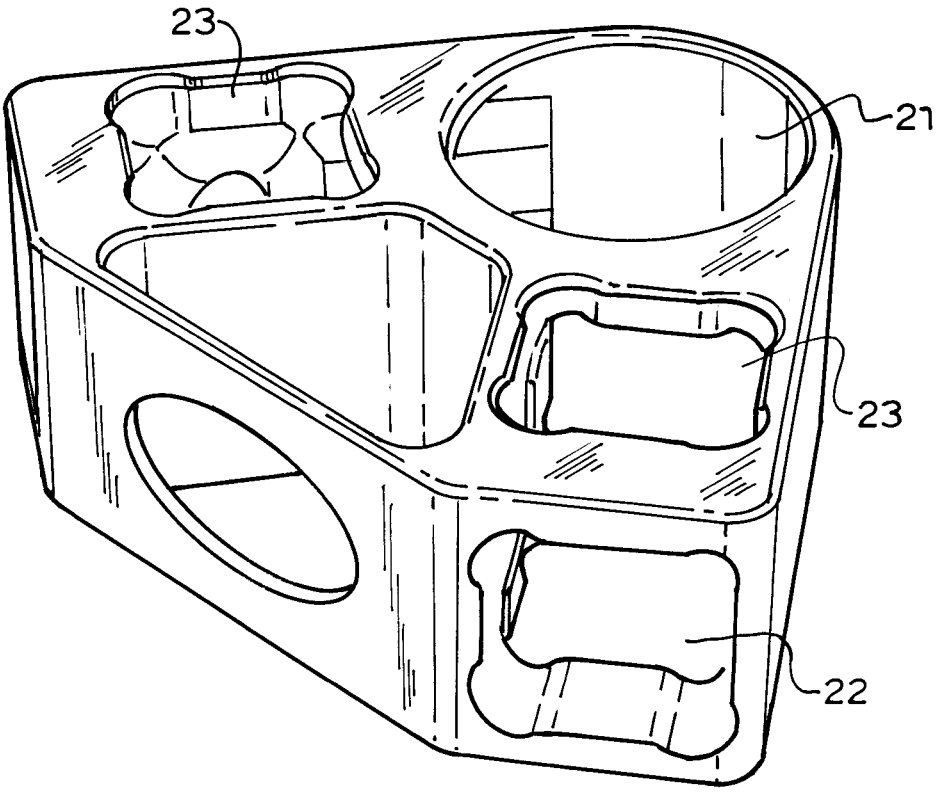
FIG. 3 is a perspective view of the base connector of the embodiment of FIG. 1.

As shown in FIGS. 1 to 4 the first embodiment of the bed post consists of a vertical post 11 inserted into the vertical post hole 21 of the base connector 20. The under mattress arms 12 and 13 are locked into the operative recesses 22 of the base connector 20.

Each of arms 12 and 13 have a spring loaded pin 16 which locks the arms into the base 20 by engaging with the pin locking hole 24.

Figure 4:
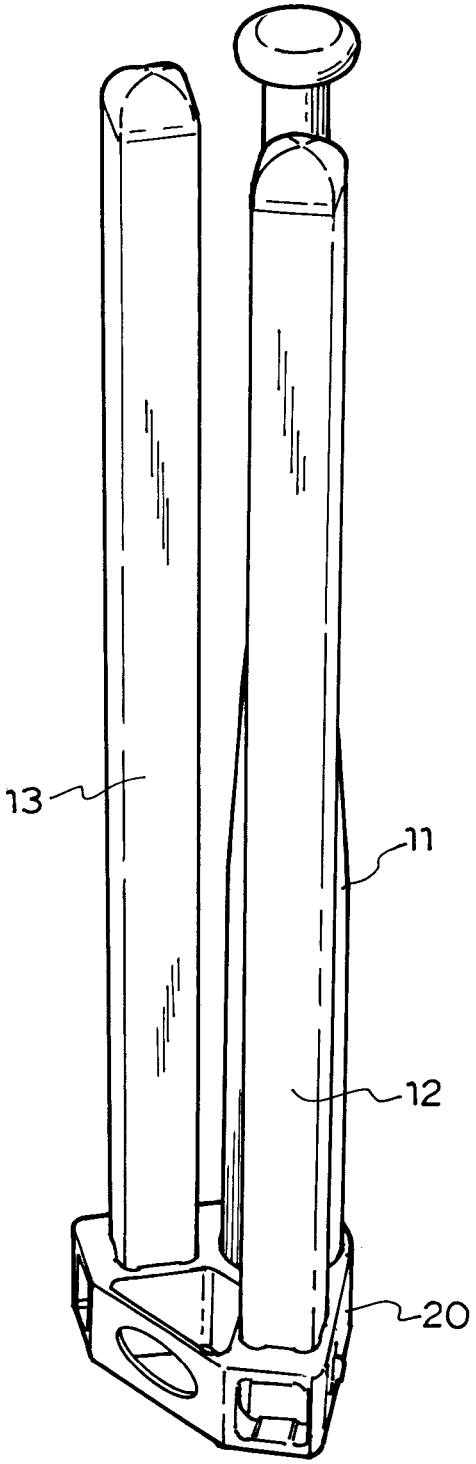
FIG. 4 is a view of the bed post of the embodiment of FIG. 1 in its folded position.

In the folded position as shown in FIG. 4 the arms 12 and 13 have been removed from the base 20 by depressing the pin 16 and the reinserting the arms 12 and 13 in the folding recesses 23.

Figure 5:
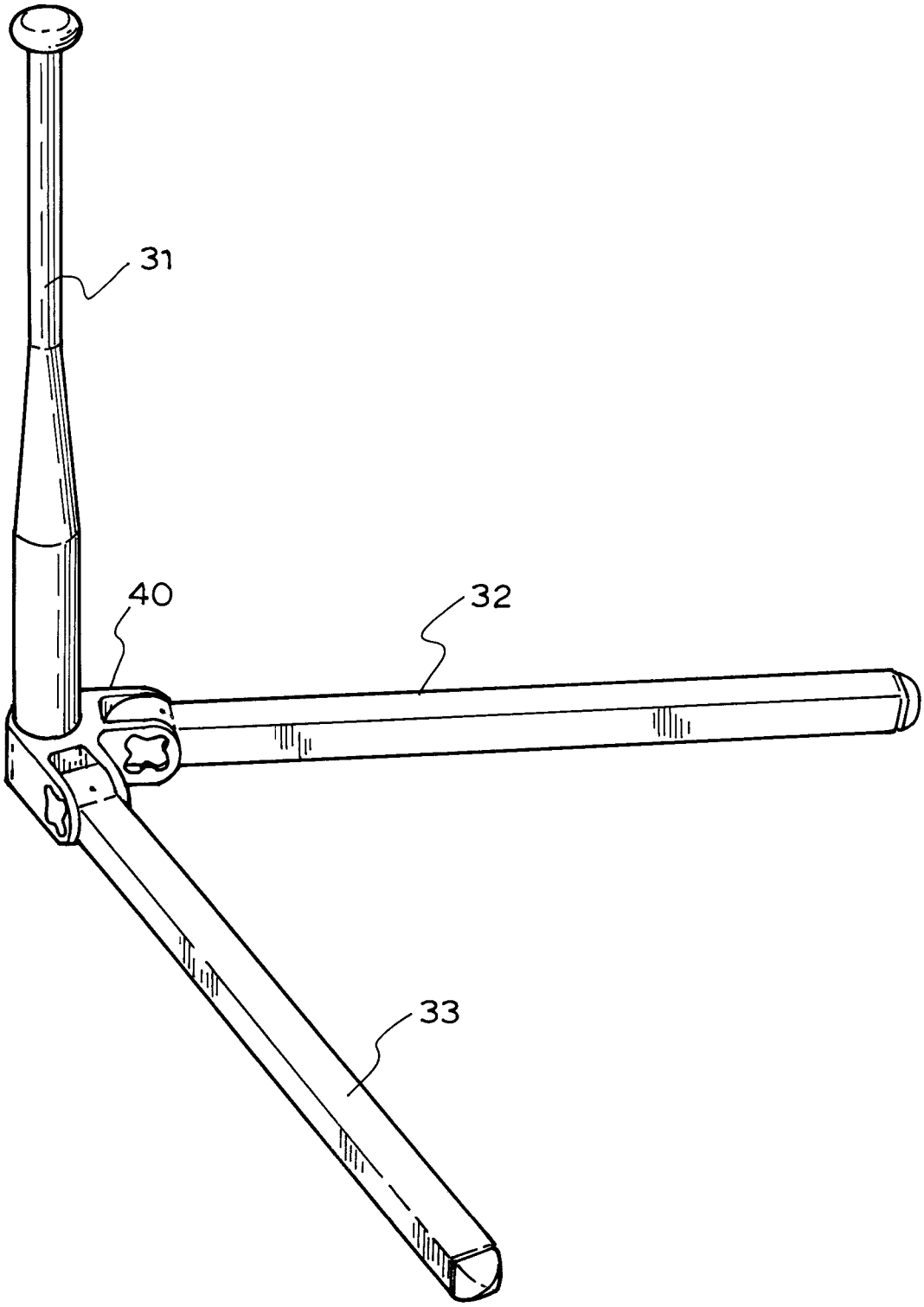
FIG. 5 is a perspective view of a second embodiment in its operative position.
Figure 6:
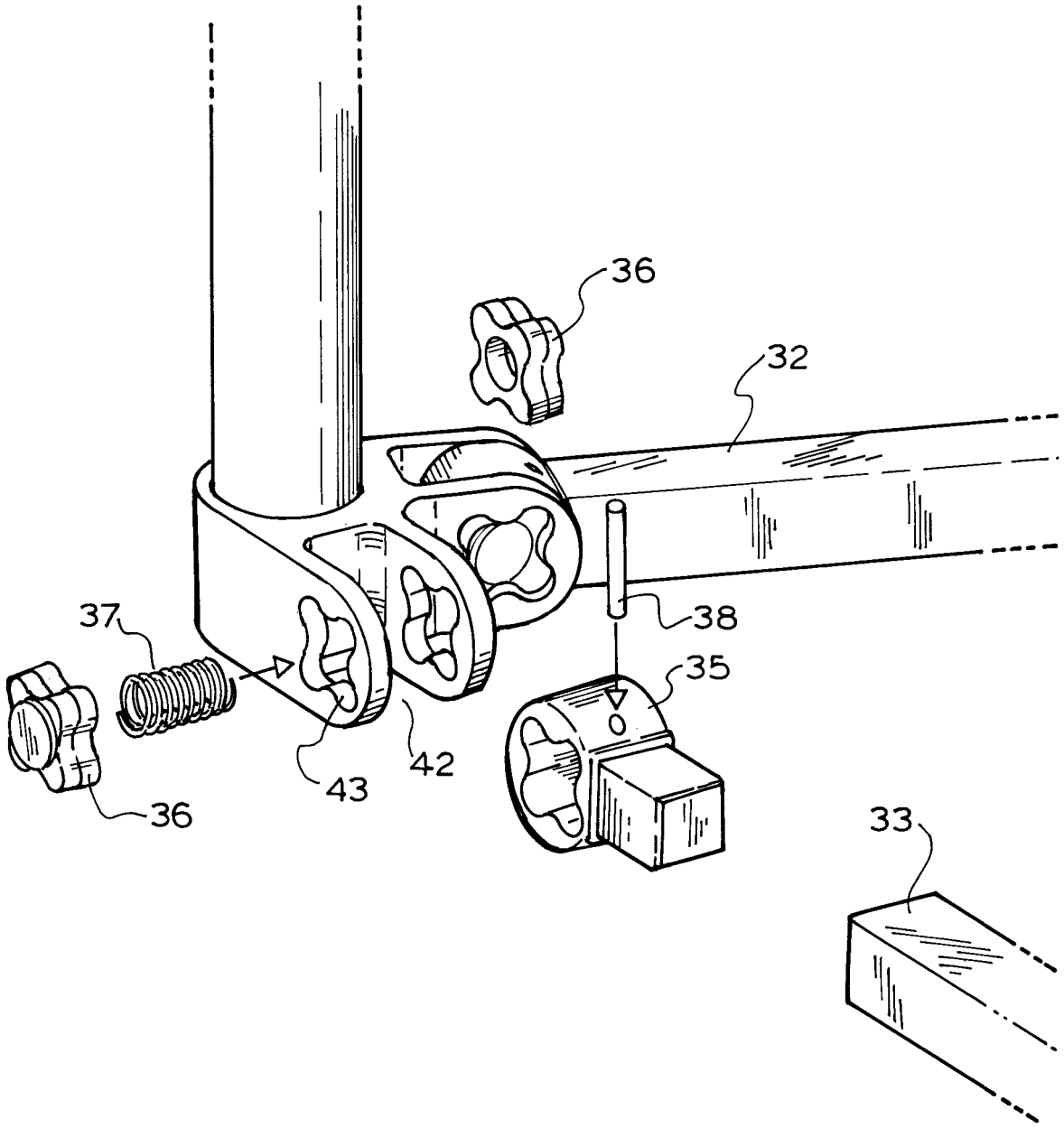
FIG. 6 is an exploded view illustrating the pivot lock system of the embodiment of FIG. 5.
Figure 7:
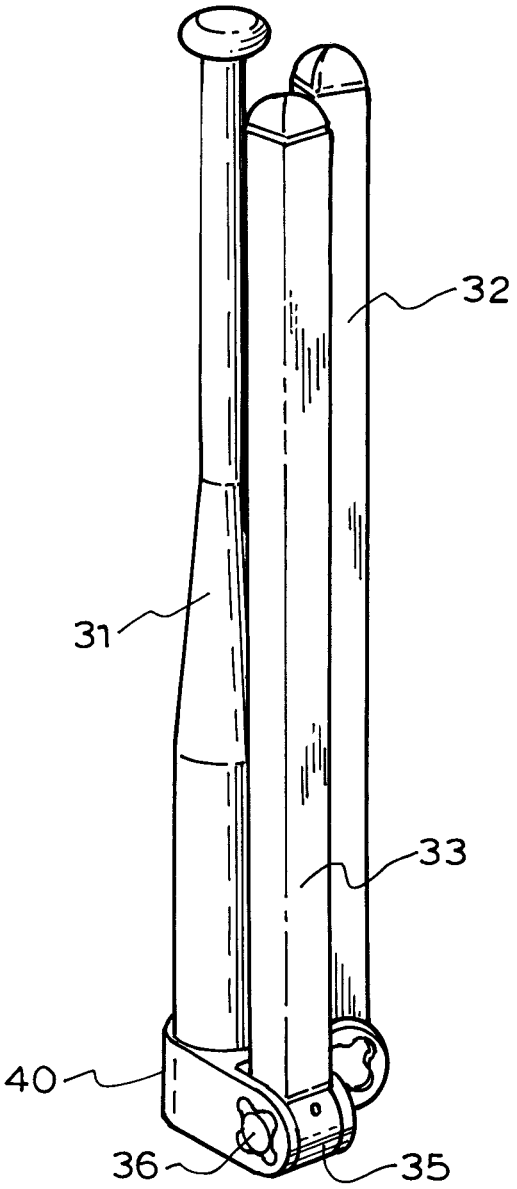
FIG. 7 is a view of the bed post of the embodiment of FIG. 5 in its folded position.
Figure 8:
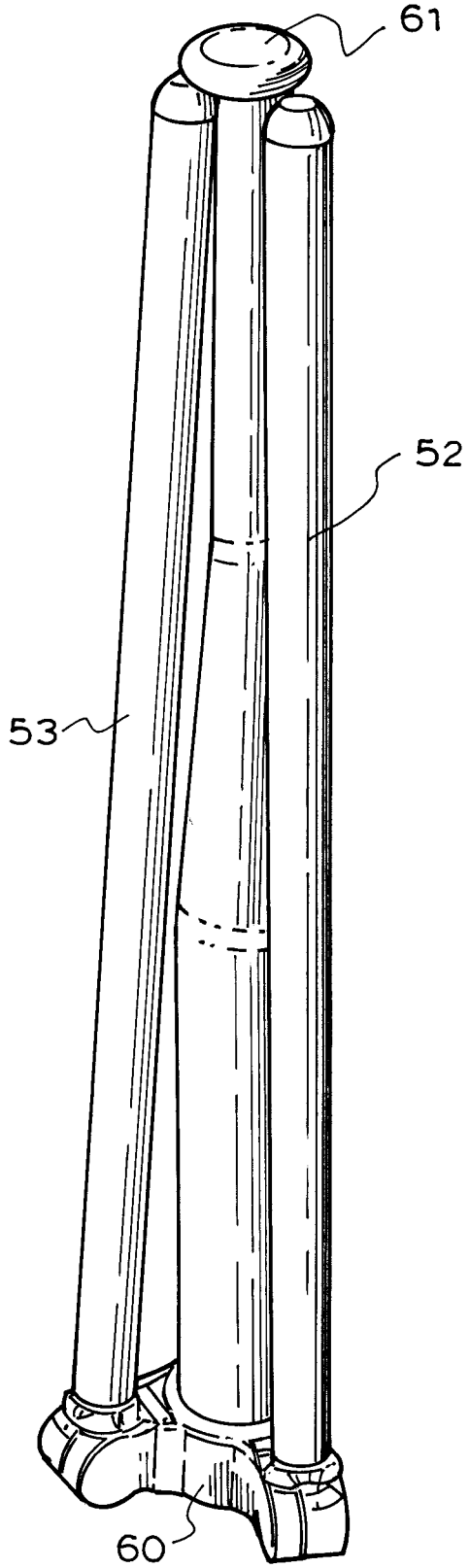
FIG. 8 is a view of the bed post of a further embodiment in its folded position.
Figure 9:
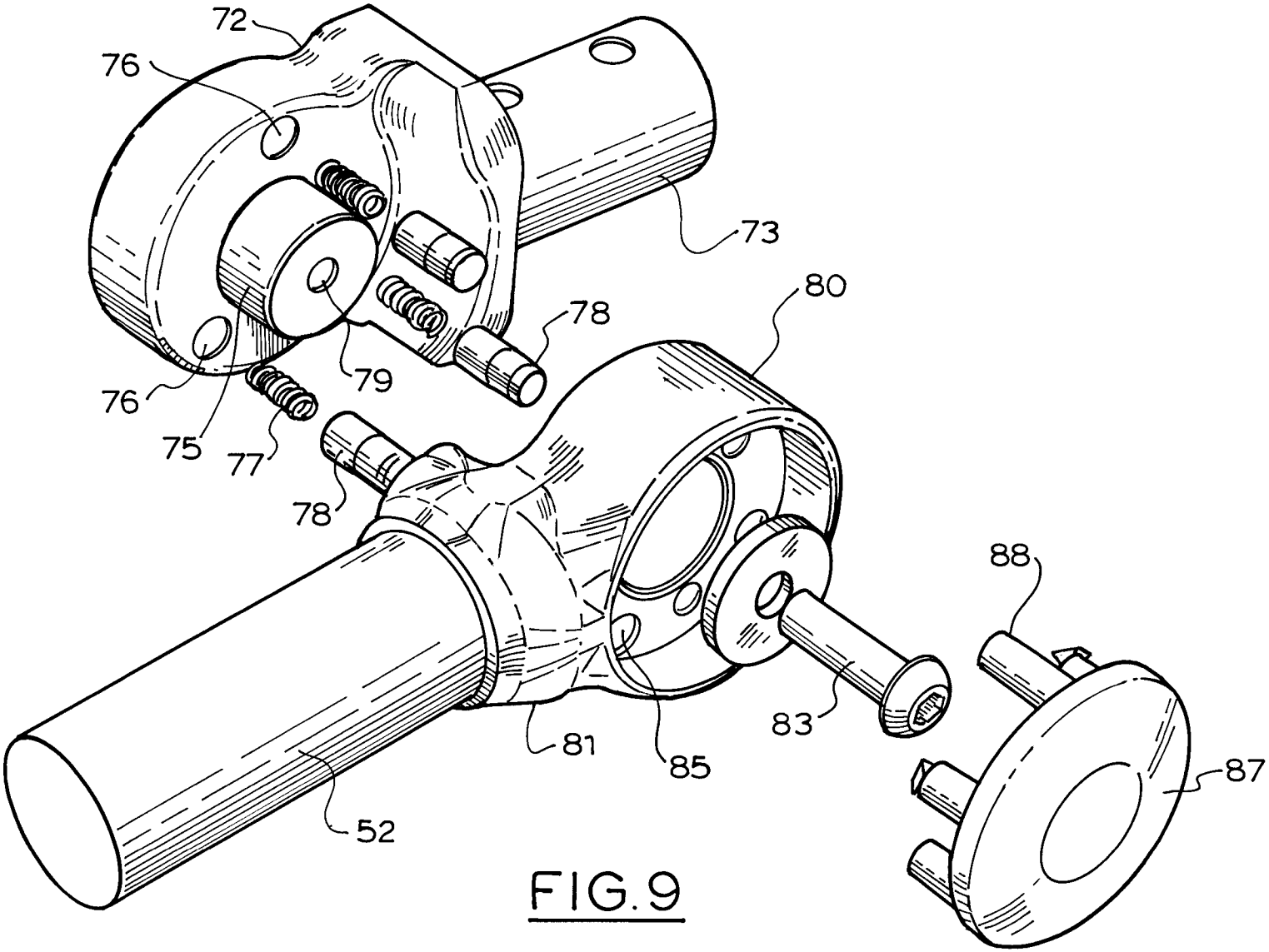
FIG. 9 is an exploded view of the arm connection mechanism of the embodiment of FIG. 8.

A second embodiment is illustrated in FIGS. 5 to 7 avoids removal and reassembly of the arms by having the arms pivotally attached to the base and moveable from an operative to a folded position.

The bed post of this embodiment consists of a vertical post 31 inserted into the vertical post hole 41 of the base connector 40. The under mattress arms 32 and 33 are lockable in two positions in the pivot recess 42 of base connector 40.

Each of arms 32 and 33 have at their base end a spring loaded shaft 35 which locks into recesses 43 in the sides of the pivot recess 42.

The spring loaded shaft 35 consists of a pair of opposed shaped gears 36 which slide in the complementary shaped passage in the shaft 35 and are pressed outward by the spring 37. The pin 38 locks the spring 37 and gears 36 in place.

The locking components are actuated by pressing the opposed spring loaded button gears 36 that disengage from the recesses 43 allowing the arms 32 and 33 to swing from one position to the other in the pivot recess 42.

In the folded position as shown in FIG. 7 the arms 32 and 33 have been swung into the folded position beside the vertical post 31.

In the embodiment of FIGS. 8 to 11 the bed post consists of a vertical post 51 inserted into the vertical post hole 61 of the base connector 60. The under mattress arms 52 and 53 are lockable in two positions in base connector 60.

Each of arms 52 and 53 have at their base end a mechanism 70 allowing the arms 52 and 53 to be moved from a folded position to an extended position. The mechanism 70 includes a hub 72 with a shaft 73 insertable into base 60. The hub 72 is cylindrical and has a central shaft 75 with a cylindrical recess 79 and 3 radially disposed recesses 76 containing springs 77 and pins 78.

Attachable to each hub 72 is a complementary hub 80 having a socket 81 into which is inserted one of the arms 52 or 53. The hub 80 has a central pin 83 insertable into the recess 79 of the shaft 75 of hub 72. Six radial recesses 85 are sized to receive the pins 78 of hub 72. A press plate 87 with attached pins 88 seats on the back face of hub 80. When the plate 87 is depressed the pins 78 are pushed by pins 88 against the springs 77 so that the hub 81 can be rotated relative to hub 72.

Figure 10:
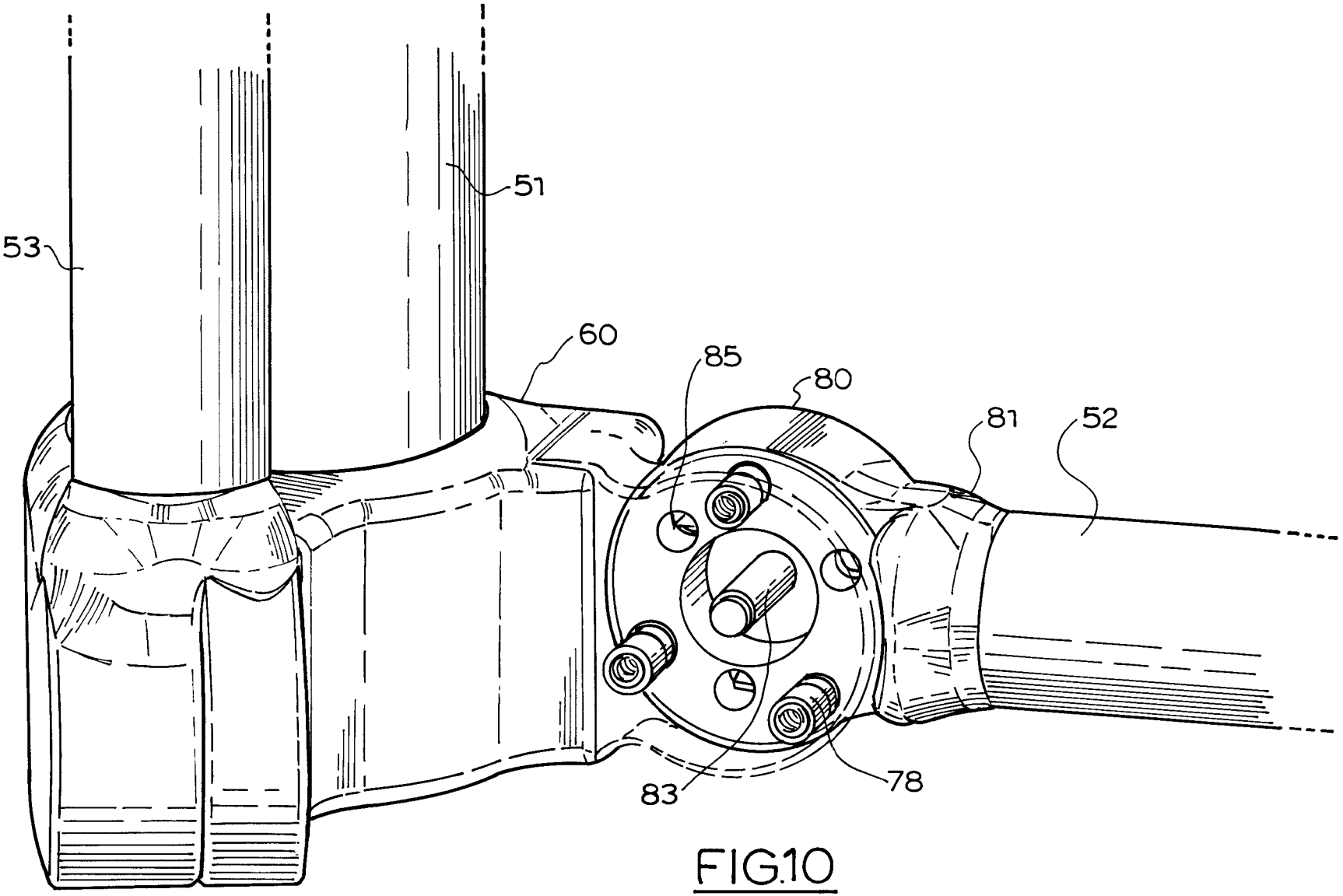
FIG. 10 is a sectional view of the arm mechanism of FIG. 9 in the extended position.
Figure 11:
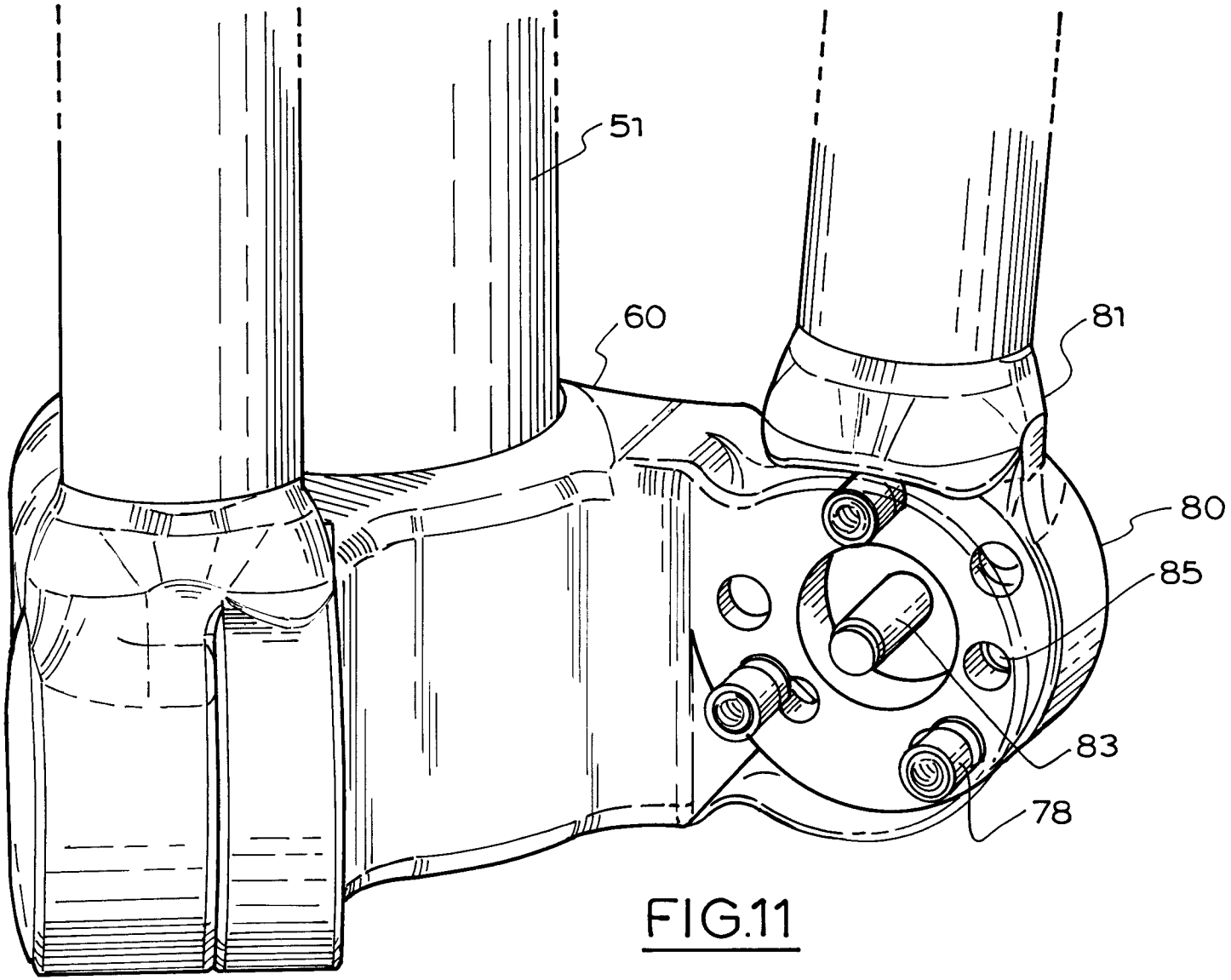
FIG. 11 is a sectional view of the arm mechanism of FIG. 9 as it approaches the folded position.

FIG. 10 shows the arm 52 in its extended position with the pins 78 seating in the recesses 85 of to lock it in position. In FIG. 11 the arm 52 is about to move into the folded position adjacent post 51 and each pin 78 is about to enter a complementary recess 85 to lock it in position.

Any suitable materials of the appropriate strength may be used to make the device of this invention. For example: in the embodiment of FIGS. 8 to 11 the preferred materials are:

Handle item 51—High strength Aluminium, Composite with carbon fibre or other high strength fibre reinforcement.

Base Connector item 60—High strength Aluminium, Composite alloy steel and high strength fibre reinforcement.

Rotating Knuckle Hub parts 72 and 81, 80, 78—High strength Alloy steel or high strength stainless steel.

Base arms item 52—High strength Aluminium tube or square hollow section, Composite eg carbon fibre composite tube.

Caps end plugs incl 87—plastic, Aluminium.

The foldable bed post of this invention is convenient to carry and stable in use.

Those skilled in the art will appreciate the advantages of this invention. Those skilled in the art will also realise that tis invention may be implemented in embodiments other than those described without departing from the core teachings of the invention.

The invention claimed is:

1. A foldable, portable disability bed support comprising:

a base portion including a base connector;

a post attached vertically to the base connector for use in self-supporting a disabled person; and at least two arms selectively attached to the base connector in an operative position and in a folded position, in the operative position the at least two arms extend radially outward from the base connector and aligned at a right angle to the post, the at least two arms configured to be disposed under a mattress, and in the folded position the at least two arms are coupled to the base connector and lie alongside the post.

2. The bed support according to claim 1 wherein the base connector includes two recesses for each arm of the at least two arms, a first recess of the two recesses aligning a first arm of the at least two arms alongside the post and a second recess of the two recesses aligning the first arm at the right angle to the post.

3. The bed support according to claim 2 wherein the base connector includes a pivot recess for each arm of the at least two arms and each arm includes a spring-loaded lock such that each arm is able to be placed in a folded position alongside the post and an operative position at a right angle to the post.

* * * * *